US005266046A

United States Patent [19]

Bogiel

[11] Patent Number: 5,266,046

[45] Date of Patent: Nov. 30, 1993

[54] HERMAPHRODITIC ELECTRICAL CONNECTION

[75] Inventor: Steven B. Bogiel, Schaumburg, Ill.

[73] Assignee: Molex Incorporated, Lisle, Ill.

[21] Appl. No.: 21,406

[22] Filed: Feb. 23, 1993

[51] Int. Cl.[5] ..... H01R 23/27

[52] U.S. Cl. ..... 439/290; 439/291

[58] Field of Search ..... 439/287, 289-291, 439/295, 850, 856, 857, 889

[56] References Cited

U.S. PATENT DOCUMENTS

| | | | |
|---|---|---|---|
| 2,744,244 | 5/1956 | Schumacher et al. | 439/290 |
| 3,634,811 | 1/1972 | Teagno et al. | 439/290 |
| 4,061,406 | 12/1977 | Kunkle | 439/291 |
| 5,035,639 | 7/1991 | Kilpatrick et al. | 439/290 |
| 5,104,332 | 4/1992 | McCoy | 439/290 |

FOREIGN PATENT DOCUMENTS

| | | |
|---|---|---|
| 2914242 | 7/1985 | Fed. Rep. of Germany . |
| 4112584 | 5/1991 | Fed. Rep. of Germany . |

*Primary Examiner*—Paula A. Bradley
*Attorney, Agent, or Firm*—Stephen Z. Weiss

[57] ABSTRACT

A hermaphroditic electrical connection includes a pair of like electrical terminals. Each terminal has a front terminal mating end and a rear conductor connecting end. The front terminal mating end includes forwardly extending spaced-apart contact arms and a generally planar contact blade. The contact blade of each terminal is adapted to be slidingly received between the contact arms of the other terminal. The contact blade and at least one of the contact arms of each terminal include complementary interengaging guides extending longitudinally in a mating direction of the terminals for laterally aligning the contact blades and the contact arms during mating of the terminals. The contact arms are configured with opposing longitudinal side edges spaced-apart more closely than lateral mid-portions of the contact arms to define four points of contact between the contact arms and the contact blade.

8 Claims, 1 Drawing Sheet

HERMAPHRODITIC ELECTRICAL CONNECTION

FIELD OF THE INVENTION

This invention generally relates to the art of electrical connections and, particularly, to a terminal which is mateable with a terminal which is identical in shape and configuration.

BACKGROUND OF THE INVENTION

Electrical terminals which are mateable with terminals of identical shapes and configurations commonly are called hermaphroditic terminals. It has been said that a hermaphroditic terminal is one that could mate with itself. Generally, a hermaphroditic terminal includes a front terminal mating end and a rear conductor connecting end. The front mating end often includes contact arms which usually are spaced-apart and mateable with contact blades. One terminal will mate with an identical terminal when the identical terminal is rotated or inverted 180° relative to the one terminal.

Certain problems constantly appear to be prevalent with hermaphroditic electrical connections. One of the problems revolves around lateral alignment of the identical terminals. In other words, when one terminal is rotated 180° relative to the other terminal, it would be desirable to have the terminals configured so that they are easily alignable in the mating direction. Another problem revolves around ensuring good electrical connections or contacts between the mating or contacting portions of the identical terminals. In the endeavors to provide terminals which are mirror images of each other when mated, good positive electrical connections often are sacrificed.

This invention is directed to providing an improved hermaphroditic electrical connection wherein a pair of like electrical terminals include means for readily aligning the terminals in a mating direction and for providing good electrical contacts or points between the terminals when mated.

SUMMARY OF THE INVENTION

An object, therefore, of the invention is to provide a new and improved hermaphroditic electrical connection of the character described.

In the exemplary embodiment of the invention, the electrical connection includes a pair of like electrical terminals. Each terminal has a front terminal mating end and a rear conductor connecting end. The front terminal mating end includes forwardly extending spaced-apart opposed contact arms and a generally planar contact blade. The contact blade of each terminal is adapted to be slidingly received between the contact arms of the other terminal.

According to one aspect of the invention, generally, the contact blade and at least one of the contact arms of each terminal include complementary interengaging guide means extending longitudinally in the mating direction of the terminal for laterally aligning the contact blades and contact arms during mating of the terminals. As specifically disclosed herein, the complementary interengaging guide means are provided by a longitudinal trough or crease in the contact blade and a detent in at least one of the contact arms for projecting into and sliding in the trough during mating of the terminals.

According to another aspect of the invention, the contact arms are configured with opposing longitudinal side edges spaced-apart more closely than lateral mid-portions of the spring arms to define four points of contact between the spring arms and the contact blades. Preferably, the terminals are stamped and formed metal components and the contact arms form opposing spring arms to further facilitate maintaining positive connections at the four points of contact.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
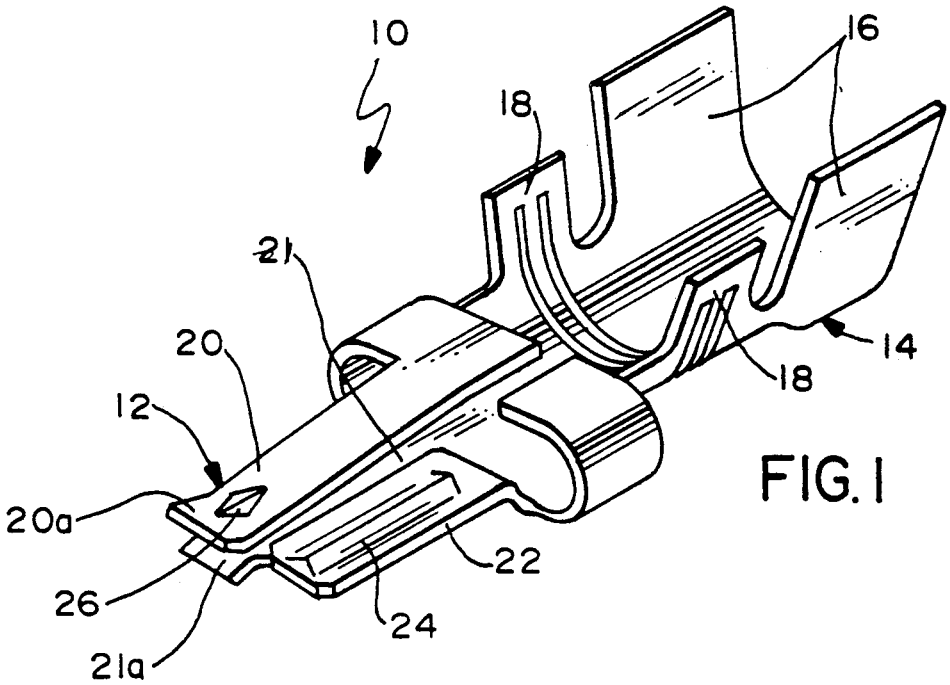
FIG. 1 is a perspective view of one of the identical terminals forming the hermaphroditic electrical connection of the invention.
Figure 2:
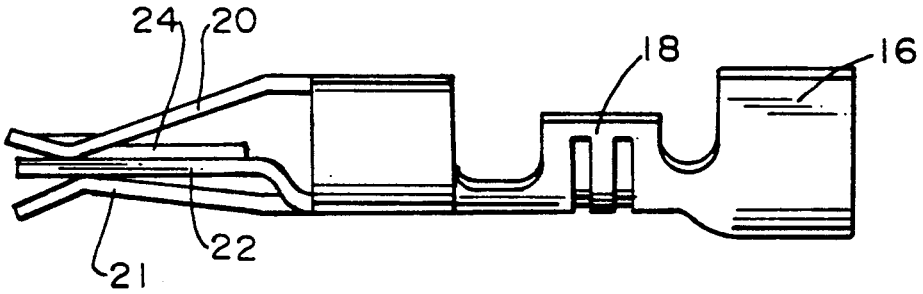
FIG. 2 is a side view of the terminal of FIG. 1.

Referring to the drawings in greater detail, and first to FIGS. 1 and 2, a terminal, generally designated 10, is one of a pair of like electrical terminals which form a hermaphroditic electrical connection according to the invention. In other words, a second terminal identical to terminal 10 can be reversed 180° of its longitudinal axis for mating and forming a hermaphroditic electrical connection as described hereinafter in relation to FIGS. 3 and 4.

More particularly, each of the pair of like terminals 10 which form the hermaphroditic electrical connection includes a front terminal mating end, generally designated 12, and a rear conductor connecting end, generally designated 14. The rear end is of a conventional configuration and includes two pairs of crimp arms 16 and 18. For example, crimp arms 18 may be adapted for crimping onto the conductive core of an insulated electrical wire, while crimp arms 16 are clamped onto the outer insulated cladding of the wire to provide strain relief therefor, as is known in the art.

Front terminal mating end 12 of each terminal 10 includes a pair of forwardly extending, spaced-apart opposed contact arms 20 and 21 having outwardly flared distal ends 20*a* and 21*a*, respectively, which define a mouth therebetween. A generally planar or flat contact blade 22 also projects forwardly alongside and laterally spaced from contact arms 20 and 21, the contact blade being located in a plane generally equidistant between contact arms 20 and 21. Therefore, during mating of a pair of identical terminals 10, contact blade 22 is adapted to be slidingly received between the pair of contact arms 20 and 21 of the other mating terminal.

According to one aspect of the invention, generally, complementary interengaging guide means are provided as extending longitudinally in the mating direction of the terminals for laterally aligning the contact blades and the contact arms during mating of the terminals. More particularly, contact blade 22 has a longitudinal trough or crease 24 formed therein. Upper contact arm 20 has an inwardly directed detent 26 (FIG. 1) and lower contact arm 21 has an outwardly directed detent 8 (see FIG. 3). These detents are designed to nest with trough 24 of contact blade 22 in order to laterally align the contact blades and arms during mating of the terminals.

Figure 3:
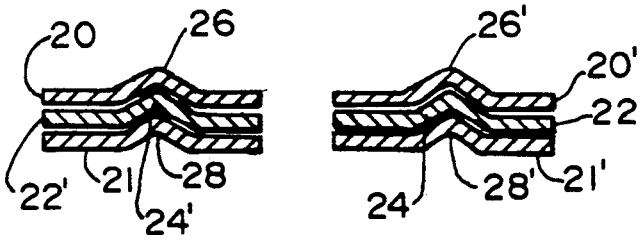
FIG. 3 is a transverse section through the front terminal mating ends of a pair of the hermaphroditic terminals in mated condition.

More particularly, referring to FIG. 3, contact arms 20 and 21 and contact blade 22 of terminal 10 are shown in combination with a contact blade 22, and contact arms 20' and 21' of a mating hermaphroditic terminal. It can be seen that detents 26 and 28 of contact arms 20 and nest with a trough 24' of contact blade 22' of the second hermaphroditic terminal; and detents 26' and 28' of contact arms 20' and 21' of the second terminal nest with trough 24 of contact blade 22 of terminal 10 as shown in FIG. 1. Not only do these complementary interengaging guide means provided by the nesting detents and troughs provide means for guiding the terminals into mating interengagement, but they assist in preventing lateral disengagement of the terminals once they are mated as shown in FIG. 3.

Figure 4:
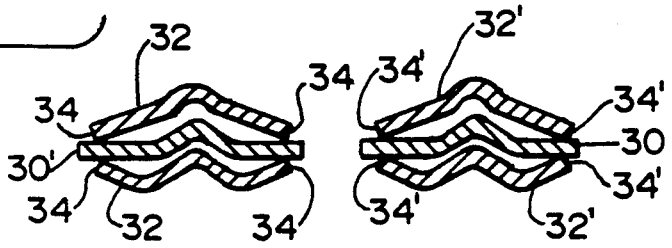
FIG. 4 is a view similar to that of FIG. 3, of an alternate embodiment of the invention.

FIG. 4 shows another aspect of the invention embodied in an alternative form, wherein contact blades 30 and 30' are mated with pairs of contact arms 32 and 32' of identical hermaphroditic terminals similar to those described above. However, it should be noted that contact arms 32 and 32' are configured with opposing longitudinal side edges 34 which are spaced-apart more closely than lateral mid-portions of the arms in each pair. Preferably, the terminals are fabricated of stamped and formed metal material and the contact arms in each pair thereof are spaced-apart less than the thickness of the respective contact blades so that the blades engage the arms, at edges 34, in a spring-biased interengagement. It can be seen that each pair of mated contact arms and contact blade provide four points of contact, for a total of eight points of contact for any two mated hermaphroditic terminals 10. These points of contact enhance the electrical conductivity characteristics between the terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a hermaphroditic electrical connection which includes a pair of like electrical terminals, each terminal having a front terminal mating end and a rear conductor connecting end, the front terminal mating end including forwardly extending spaced-apart opposed contact arms and a generally planar contact blade, the contact blade of each terminal being adapted to be slidingly received between the contact arms of the other terminal, wherein the improvement comprises the contact blade and at least one of the contact arms of each terminal including complementary interengaging guide means extending longitudinally in a mating direction of the terminals for laterally aligning the contact blades and contact arms during mating of the terminals.

2. In a hermaphroditic electrical connection as set forth in claim 1, wherein said terminals comprise stamped and formed metal components and said contact arms comprise opposing spring arms.

3. In a hermaphroditic electrical connection as set forth in claim 2, wherein said spring arms are configured with opposing longitudinal side edges spaced-apart more closely than lateral mid-portions of the spring arms to define four points of contact between the spring arms and the contact blade.

4. In a hermaphroditic electrical connection as set forth in claim wherein said complementary interengaging guide means comprise a longitudinal trough in the contact blade and a detent in at least one of the contact arms for projecting into and sliding in the trough during mating of the terminals.

5. In a hermaphroditic electrical connection as set forth in claim wherein said contact arms are configured with opposing longitudinal side edges spaced-apart more closely than lateral mid-portions of the contact arms to define four points of contact between the spring arms and the contact blade.

6. In a hermaphroditic electrical connection as set forth in claim 5, wherein said terminals comprise stamped and formed metal components and said contact arms comprise opposing spring arms, the opposing side edges of the spring arms being spaced-apart less than the thickness of the contact blade.

7. In a hermaphroditic electrical connector as set forth in claim 1 wherein the contact arm is being configured with opposing longitudinal side edges spaced-apart more closely than the lateral mid-portions of the contact arms to define four points of contact between the contact arms and the contact blade.

8. A hermaphroditic electrical connection as set forth in claim 7 wherein said terminals comprise stamped and formed metal components and said contact arms comprise opposing spring arms, the opposing side edges of the spring arms being spaced-apart less than the thickness of the contact blade.

* * * * *